United States Patent [19]

Roulet Dubonnet et al.

[11] Patent Number: 4,604,507

[45] Date of Patent: Aug. 5, 1986

[54] MINIATURE CIRCUIT BREAKER WITH IMPROVED INSULATION LEVEL

[75] Inventors: Jean-Pierre Roulet Dubonnet, Eybens; Louis Boillot, Grenoble; Gilbert Mora, St. Nicolas de Macheran, all of France

[73] Assignee: Merlin Gerin, Grenoble, France

[21] Appl. No.: 680,465

[22] Filed: Dec. 11, 1984

[30] Foreign Application Priority Data

Dec. 26, 1983 [FR] France ..... 83 20899

[51] Int. Cl.[4] ..... H01H 33/04

[52] U.S. Cl. ..... 200/144 R

[58] Field of Search ..... 200/144 R

[56] References Cited

U.S. PATENT DOCUMENTS

| | | | |
|---|---|---|---|
| 2,733,312 | 1/1956 | Christensen | 335/38 |
| 3,842,376 | 10/1974 | Mune | 335/202 |
| 3,953,812 | 4/1976 | Heft et al. | 335/23 |
| 4,011,420 | 3/1977 | Heft | 200/144 R |

FOREIGN PATENT DOCUMENTS

| | | |
|---|---|---|
| 0080924 | 6/1983 | France . |
| 905639 | 9/1962 | United Kingdom . |

*Primary Examiner*—Robert S. Macon

*Attorney, Agent, or Firm*—Parkhurst & Oliff

[57] ABSTRACT

The separation partition (44) of the arc formation chamber (38) from the mechanism of a miniature circuit breaker is formed so as to follow at least on a part of its length some equipotential lines generated between the separated contacts (20, 22) of the circuit breaker. This particular shape of the partition (44) increases the insulating level of the appliance after a fault elimination.

4 Claims, 4 Drawing Figures

FIG. 2
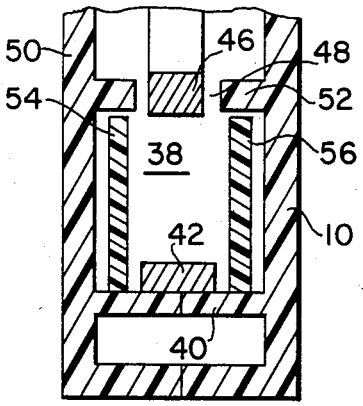
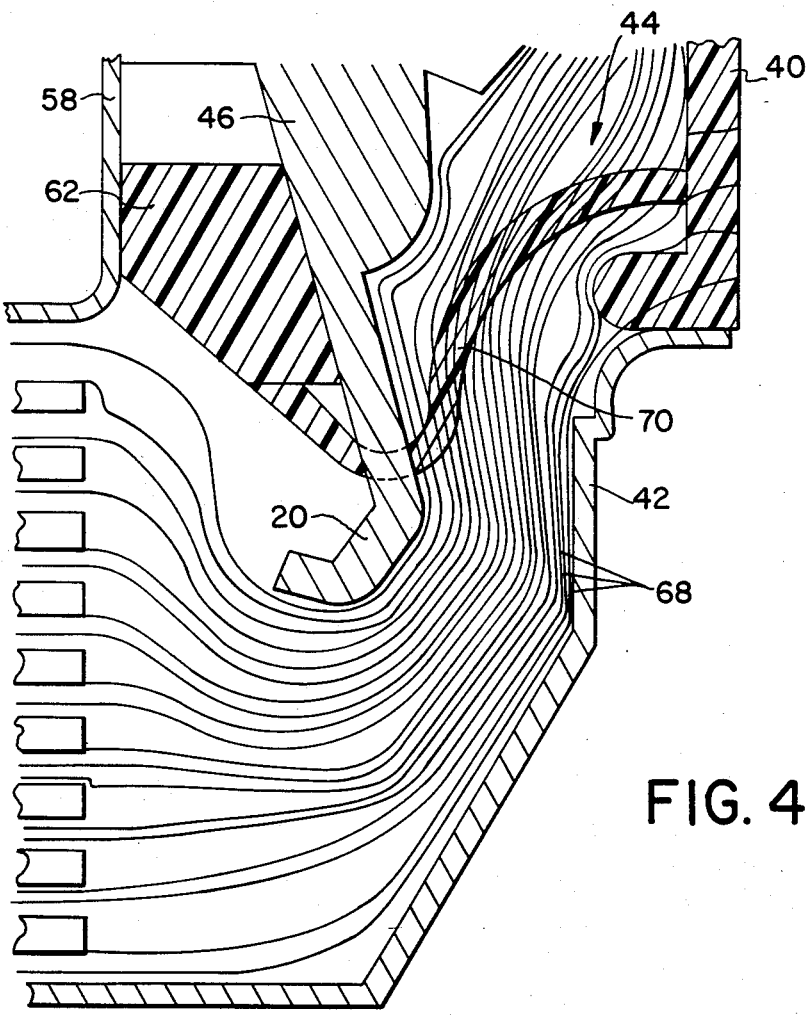
FIG. 4

MINIATURE CIRCUIT BREAKER WITH IMPROVED INSULATION LEVEL

BACKGROUND OF THE INVENTION

The invention relates to a miniature electric circuit breaker with an insulating moulded casing having an arc formation chamber containing a pair of separable contacts, an arc extinction chamber communicating with the arc formation chamber and a housing chamber for the mechanism, separated from the arc formation chamber by an intermediate insulating partition wall. The wall has a rectangular passage slot of the support arm of the moving contact, the slot being elongated in the moving direction of the arm and laterally delimited by two insulating ribs of the partition encompassing the arm with weak play and extending until the side walls of the moulded casing.

When a short-circuit is cut off, the arc which develops in the arcing chamber releases much heat and damages the casing parts located close to its passage. Furthermore the arc roots pull some metallic particles out of the contacts and the arcing horns. The degradation products, composed mainly by carbon, metals and oxydes form preferentially a deposit on the ribs and in the angles, wherever the gaseous flow which sweeps them along is deviated by an obstacle. In particular they form a deposit on the intermediate partition between the arc formation chamber and the chamber containing the mechanism. In all the known realizations this partition with slot extends between the casing parts near the fixed contact and the casing parts near the moving contact at the shortest. This arrangement has the disadvantage to create a preferential creepage path between the fixed contact and the moving contact which degrades the insulation level of the appliance.

SUMMARY OF THE INVENTION

An object of the present invention is to improve the insulation level of the circuit breaker. It is characterized in that the ribs extend at least on a part of their length parallel to the equipotential lines of the electric field generated inside the casing in the separation zone of the contacts in open position.

The partition part formed by the ribs parallel to the equipotential lines is submitted to a zero potential gradient, which forbids any creepage along the ribs of the partition, even if these are polluted by deposits likely to alter the dielectric strength.

The partition can be continuous, the ribs being connected on both ends by round parts to the casing walls which delimit the formation chamber to limit the communication opening at the most and thereby the gas volume likely to escape from the formation chamber toward the mechanism chamber. In that case the partition has an S-shape, the central part of which is parallel to the equipotential lines and the ends of which are connected to insulating parts near of the fixed contact and near of the moving contact respectively.

If the required sealing is less important, it is possible to provide discontinuities in the partition and more especially in the end parts crossing the equipotential lines. These discontinuities increase the insulation level between the contacts, but to the prejudice of the sealing.

The partition can be secured to or come from moulding with the shells forming the insulating moulded casing. This partition can also be integral with or be secured to insulating plates disposed on both sides of the formation chamber.

The gain upon the insulation level in the open position of the contacts can reach 50% and depends among other things of the thickness of the partition. The partition according to the invention can be applied to all kinds of circuit breakers or interrupters.

BRIEF DESCRIPTION OF THE DRAWINGS

Other advantages and technical data will more clearly appear from the following description, wherein reference is made to the accompanying drawings, in which:

FIG. 2 is a section viewed along the line II—II in FIG. 1;

FIG. 4 is a view similar to the one of FIG. 3, showing the equipotential lines and a shape variant of the partition according to the invention.

DESCRIPTION OF THE PREFERRED EMBODIMENT

Figure 1:
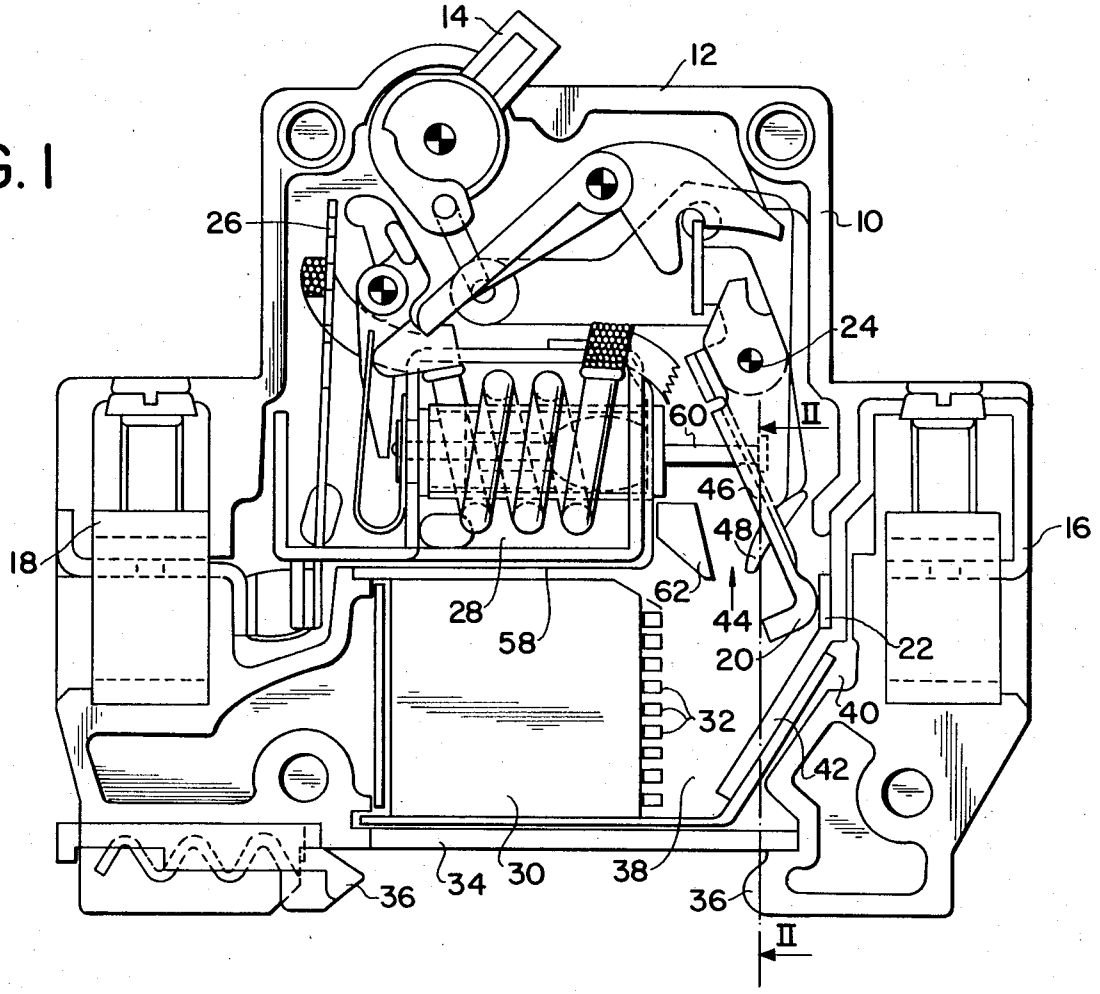
FIG. 1 is a schematic view of a pole of a circuit breaker according to the invention, the side wall being removed.

On FIG. 1 the pole of a miniature electric circuit breaker comprises a casing 10 made of a moulded insulating material having a handle 14 to operate the circuit breaker on the front side 12, and on the two narrow lateral faces the connecting terminals 16, 18. Inside the casing 10 is housed a fixed contact 22 which cooperates with a moving contact 20 mounted in rotation on an axis 24. Furthermore the casing 10 comprises a thermal release 26 and an electromagnetic release 28 likely to induce an automatic opening of the contacts 20, 22 in case of overload or short-circuit. In the lower part of the casing 10 is disposed an arcing chamber 30 formed by a pile-up of plate-sheets 32 extending parallel to the rear 34 of the casing 10. Fixing clamps 36 locked with the rear 34 are likely to cooperate with a support symmetrical DIN rail according to well known manner from the specialists. At the entrance of the arcing chamber is disposed an arc formation chamber 38 containing the fixed contact 22 and the moving contact 20. The arc formation chamber 38 freely communicates with the arcing chamber 30, the opposite side being delimited by an insulating wall 40 along which extends an arcing horn 42 connecting the fixed contact 22 to the end of the plate-sheet 32 built onto the rear 34. A partition designated by the general mark 44 extends between the arc formation chamber 38 and the chamber disposed in the upper part of the casing 10. The partition 44 shows a slot 48 for the passage of the support arm 46 of the moving contact 20 to permit a free clearance of the latter from the closed position represented in FIG. 1 to the open position represented in FIG. 3. The partition 44 limits the gas leaks generated by the arc in the formation chamber 38 toward the mechanism so as to blow the arc from the formation chamber 38 toward the arcing chamber 30 where it goes out. Referring to FIG. 2, it is seen that the slot 48 of the partition 44 is laterally delimited by a pair of ribs 50, 52 encircling the contact arm 46 with weak play. In the example represented in FIG. 2, the ribs 50, 52 come from moulding with the two constituting shells of the moulded casing 10. The arc formation chamber 38 is sideways delimited by a pair of plates 54, 56 advantageously made of gas-emanating material, which confines with the casing 10 passages of gases recirculation promoting the arc shift toward the arcing chamber 30. The magnetic release 28 comprises a yoke 58, a part of which forms the end plate-sheet of the arcing chamber 30 and a metallic rod 60 cooperating with the arm of the moving contact 46 to pull out the latter toward the opening position. Such a circuit breaker is well known of the specialists and it is unnecessary to describe its composition or its operation more in detail.

Figure 3:
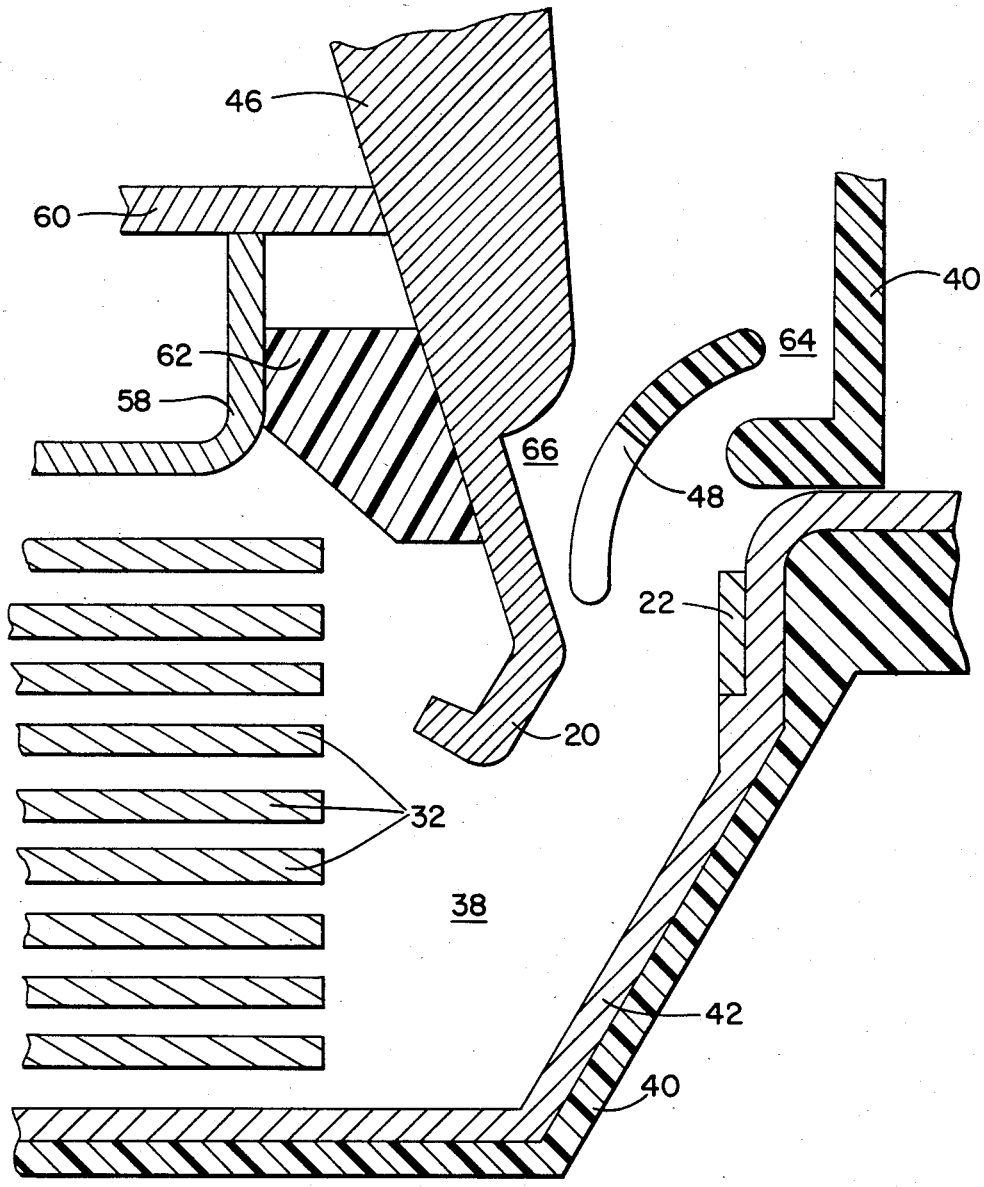
FIG. 3 is a partial view of FIG. 1, on an enlarged scale, showing the moving contact in open position.

In open position of the circuit breaker, shown in FIGS. 3 and 4, the voltage is applied between the contacts 20, 22, the arcing horn 42 being at the potential of the fixed contact 22, whereas the yoke 58 and the drawer rod 60 are at the potential of the moving contact 20, 46. The equipotential lines 68 between these conducting parts 22, 42; 20, 46, 58, 60 are drawn on FIG. 4. Near the fixed contact 22 is disposed an insulating wall 40 belonging to the casing 10, an insulating wall 62 of the casing 10 extending at the rear of the moving contact 20, 46 in open position. According to the present invention the partition 44 with slot 48 extends at least on a part 70 of its length parallel to the equipotential lines 68. In the realization mode according to FIG. 3, the beanshaped partition 44 is separated from the insulating parts 40, 62 by discontinuities 64, 66 disposed in the partition zone crossing the equipotential lines. In the example represented on FIG. 4 the partition 44 continuously extends between the insulating part 40 next to the fixed contact 22 and the insulating part 62 next to the moving contact 20 having a general S-shape. It is advisable to note that the round shape of the end parts of the slot partition 44, connecting the central part 70, parallel to the equipotential lines, to the walls 40, 62 of the casing 10 avoids any acute angle likely to alter the dielectric strength. According to FIG. 4, the continuous partition 44 ensures a better sealing but an insulation level below the one of the partition with discontinuities 64, 66, shown in FIG. 3. It is clear that the partition 44 can be of a different shape, the main point being to comprise a part parallel or slightly parallel to the equipotential lines. This part parallel to the equipotential lines is advantageously at the level of the opening 48, but it could be at the level of the full parts connecting the casing 10 walls.

In the example represented on the figures, the partition 44 comes from moulding with the casing 10, but it is clear that it can be formed by inlaid work supported either by metallic parts such as the horn 42 and the yoke 58, or by insulating parts such as plates 54, 56. The partition 44 and more especially the ribs 50, 52 can however belong to the plates 54, 56, the sealing of the interface between the plates and the lateral walls 10 being able to be ensured by a recess of fitting on a well known manner. The nature of the material and the thickness of the partition 44 are determined versus the required insulation level. It should be noted that the particular shape according to the invention of the partition 44 permits to increase the insulation capacity of any arcing appliance whatever its voltage or the type of appliance may be. The present invention has permitted to increase the insulation level by an especially simple modification which has not modified the manufacture cost of the appliance.

We claim:

1. A miniature electric circuit breaker with an insulating moulded casing having an arc formation chamber, a pair of cooperating fixed and movable contacts disposed in said arc formation chamber and generating inside said arc formation chamber an electrical field defined by equipotential lines in a separation zone of said contacts in an open position, an arc extinction chamber communicating with the arc formation chamber, a mechanism for moving said contacts between an engaged condition and a disengaged condition, a chamber for the mechanism housing separated from the arc formation chamber by an intermediate insulating partition having a rectangular slot and two ribs for laterally delimitating said slot, a carrier supporting the movable contact and crossing said slot for cooperating with said mechanism, said carrier being longitudinally movable within said rectangular slot and laterally encompassed by said ribs, said ribs extending at least over a part of their length parallel to the equipotential lines of said electrical field, so that said ribs are submitted to a zero potential gradient and prevent any current creepage along said partition ribs.

2. A miniature electric circuit breaker according to claim 1, wherein said casing comprises two insulating walls delimiting the arc formation chamber on the side of the fixed contact and on the side of the movable contact in open position, said partition extending between said two walls and being connected to said walls.

3. A miniature electric circuit breaker according to claim 2, having a S-shaped partition wall with two round end parts, the central part of this wall extending parallel to the equipotential lines and the two round end parts fitting together on said two walls.

4. A miniature electric circuit breaker according to claim 3, wherein said casing comprises two coupled half shells, said partition extending from moulding with said shells, one of said ribs being integral with one of said shells and the other of said ribs being integral with the other of said shells.

* * * * *